United States Patent [19]

Calabro

[11] Patent Number: 4,500,064

[45] Date of Patent: Feb. 19, 1985

[54] MAST SUPPORT ASSEMBLY

[76] Inventor: Philip Calabro, 9025 Linton St., Silver Spring, Md. 20901

[21] Appl. No.: 457,359

[22] Filed: Jan. 12, 1983

[51] Int. Cl.[3] ..... A01K 97/10

[52] U.S. Cl. ..... 248/539; 248/74.1; 343/892

[58] Field of Search ..... 248/539, 534, 74 R, 248/65; 52/110, 173 R, 27; 343/880, 892

[56] References Cited

U.S. PATENT DOCUMENTS

| | | | |
|---|---|---|---|
| 2,543,900 | 3/1951 | Dudley et al. | 248/539 |
| 2,550,001 | 4/1951 | Button | 248/74 R |
| 2,630,531 | 3/1953 | Finneburgh | 343/892 |
| 2,718,941 | 9/1955 | Robinson | 248/539 |
| 3,245,642 | 4/1966 | Dicke | 248/539 |
| 3,802,653 | 4/1974 | Nyulassie | 248/539 |
| 3,943,524 | 3/1976 | Sample | 248/539 |
| 4,267,994 | 5/1981 | Lynch et al. | 248/65 |

FOREIGN PATENT DOCUMENTS

| | | | |
|---|---|---|---|
| 1244688 | 9/1960 | France | 343/892 |

*Primary Examiner*—William H. Schultz
*Assistant Examiner*—Ramon O. Ramirez
*Attorney, Agent, or Firm*—Epstein & Edell

[57] ABSTRACT

A support assembly for a mast includes a mounting plate to which a cradle can be permanently fused or attached by means of spacers of different thickness to select the desired spacing of the mast from the mounting plate. The cradle has an arcuate mast support surface which extends axially to a length at least twice the arcuate length. The arcuate arc length is preferably less than 180°. The mounting plate is adapted to be secured to a masonry wall, such as the side of chimney, by means of masonry screws or the like. To this end the mounting plate is provided with at least two mounting holes, at least one of which is elongated to assure that both mounting holes overlie mortar spaces between bricks in the masonry wall. The supported mast is clamped to the cradle by means of a U-bolt and toothed bracket plate. In the preferred embodiment, two such assemblies are secured to the wall with their mast support surfaces in axial alignment.

17 Claims, 9 Drawing Figures

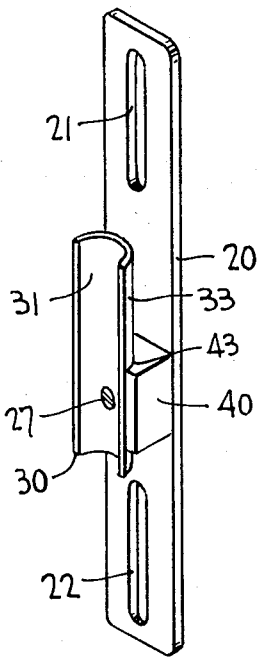
FIG. 3
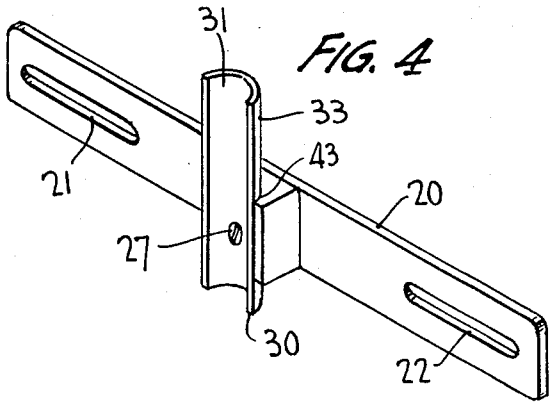
FIG. 4
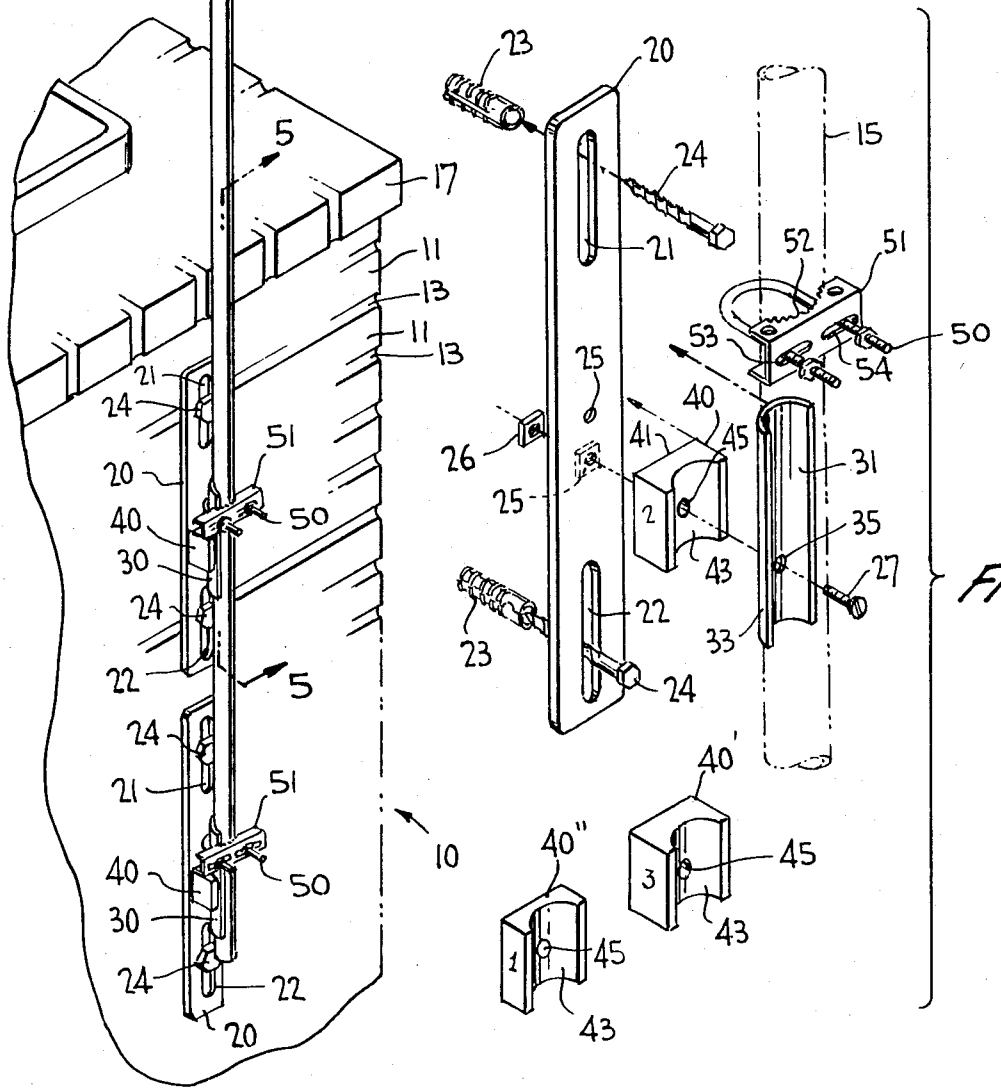
FIG. 2
FIG. 1

MAST SUPPORT ASSEMBLY

BACKGROUND OF THE INVENTION

1. Technical Field

The present invention relates to mast support assemblies and, more particularly, to mast support assemblies which are particularly suited for securing television antenna masts to masonry walls and chimneys.

2. The Prior Art

Optimum reception of television signals at a given location is achieved when the antenna is secured to the highest structure at that location. For most homes, the highest structural portion is a chimney which very often is made of brick and mortar. The conventional technique for securing a television antenna mast to a masonry chimney is by means of cables wrapped about the chimney. An example of this technique is illustrated in U.S. Pat. No. 3,208,703 to Arnold et al. This cable-wrapping approach has a number of associated disadvantages. For example, when the chimney periphery is large, installation requires more than one person. In other words, a single person can not reach around the chimney periphery to wrap the cable and secure the mast. In addition, the cable tension changes with temperature so that the force holding the antenna mast against the chimney occasionally loosens and moves with the wind. This produces interference in the received television signal as well as introducing the danger of the entire antenna coming loose and falling from the chimney. Further, the upper lip of many chimneys projects horizontally outward beyond the main chimney periphery, thereby requiring a make-shift spacer to be installed between the chimney and antenna mast so that the mast can clear the projecting lip. This severely impairs the integrity of the cable-wrap mounting arrangement and further complicates the installation process.

In attempting to solve the aforesaid problems, I discovered additional areas of concern. For example, in attempting to secure an antenna mast directly to a masonry chimney with a bracket and masonry screws, or the like, I noted that the structural integrity of the mounting arrangement was poor. Moreover, the bracket mounting holes did not always align with mortar spaces between the bricks and the chimney wall, thereby requiring the creation of additional mounting holes. Further, the spacing of the antenna mast to clear the lip of the chimney is not completely solved merely by spacing a mounting bracket from the chimney wall. Specifically, it is desirable, on the one hand, to clear the chimney lip; but it is also desirable to keep the mast as close to the chimney as possible to take advantage of the chimney structural support and to minimize the torque load created by the weight of the mast on the extended bracket and spacer.

OBJECTS AND SUMMARY OF THE INVENTION

It is therefore a primary object of the present invention to provide a mounting arrangement for a television antenna mast which permits the mast to be simply and securely mounted on a masonry chimney as close to the chimney as possible while clearing the upper lip of the chimney.

It is another object of the present invention to provide a mast mounting arrangement which can be easily secured to any masonry chimney regardless of the size of the chimney and the size and spacing between bricks in the chimney wall.

Still another object of the present invention is to provide a mast mounting assembly which permits a mast to be mounted on a structural wall in substantially any orientation in a plane parallel to the wall.

A further object of the present invention is to provide a mast mounting assembly which is simple to install and which securely supports the mast against wind forces.

In accordance with the present invention, a mast mounting assembly includes a mounting plate and cradle. The mounting plate has a flat rear surface adapted to abut a structural wall to which the plate is secured by screws, or the like, extending through mounting holes in the plate. At least one of the mounting holes is an elongated slot which permits the mounting holes to be positioned in alignment with mortar spaces between bricks when the structural wall is a masonry wall. The cradle has a mast support surface which faces away from the mounting plate and which is elongated in the direction of the supported mast with an arcuate cross-section. The axial length of the mast support surface is considerably larger than the arcuate cross-section length. In the preferred embodiment the cross-sectional length subtends an arc which is less than 180° but greater than 120°. The supported mast is clamped in the cradle along the mast support surface by a U-bolt to which a tooth bracket member is secured against the mast.

In one embodiment the cradle is welded, braised or otherwise permanently fused to the front surface of the mounting plate so that the entire unit is integral or inseparable. The fused portion is in the form of a bridge or neck which extends the cradle transversely away from the mounting plate so that a supported mast can clear the projecting upper lip of a chimney to which the mounting plate is secured.

In another embodiment the mounting plate and cradle are separate units which are interconnected by a spacer. The particular space is selected by its width dimension in accordance with the spacing required to permit the mast to clear the chimney lip or other overhanging projection. Aligned screw holes in the mounting plate, spacer and cradle permit the three elements to be easily secured together by a screw and nut arrangement. The cradle is preferably in the form of a longitudinally-truncated pipe section and the spacer includes an arcuate recess within which the pipe section is received. By rotating the spacer about its screw hole with respect to the mounting plate, the arcuate recess and cradle can be secured at various angles in a plane parallel to the mounting plate and the structural wall.

In the preferred embodiment two assemblies are employed to support the mast, the assemblies being oriented with their mast support surfaces in axial or longitudinal alignment.

It should be stressed that, while the embodiments of the invention described herein are oriented toward supporting a television antenna mast on a masonry wall or chimney, the principles of the present invention are applicable to supporting any mast on substantially any structural wall or surface.

BRIEF DESCRIPTION OF THE DRAWINGS

These and other objects, features and many of the attendant advantages of the invention will be better understood upon a reading of the following detailed description when considered in connection with the accompanying drawings wherein like parts in each of the several figures are identified by the same reference number, and wherein:

FIG. 1 is a view in perspective of a mast mounted on a masonry chimney with two mounting units constructed in accordance with the principles of the present invention;

FIG. 2 is an exploded view in perspective of the components of a mast mounting unit of the present invention;

FIG. 3 is a view in perspective of an assembled mast mounting unit of the present invention, showing the support cradle and mounting plate in mutually parallel orientation;

FIG. 4 is a view in perspective of an assembled mast mounting unit of the present invention, showing the support cradle and mounting plate in mutually perpendicular orientation;

DESCRIPTION OF THE PREFERRED EMBODIMENTS

Figure 5:
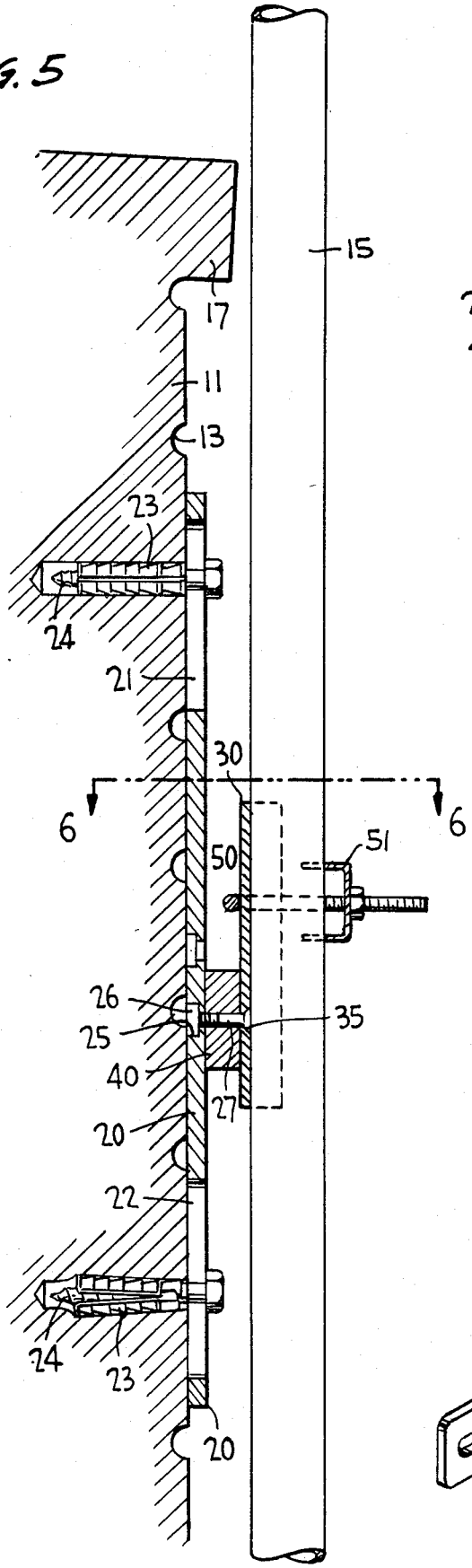
FIG. 5 is a view in section taken along lines 5—5 of FIG. 1.

Referring specifically to FIGS. 1–6 of the accompanying drawings in greater detail, a conventional masonry chimney 10, made of multiple bricks 11 spaced by mortar 13, serves as a structure on which a television antenna mast 15 is to be mounted. The chimney has an overhang or lip 17 projecting transversely outward from its top.

A mounting unit for mast 15 includes a mounting plate 20, a cradle member 30 and a spacer element 40. The mast 15 is secured to cradle member 30 by means of a U-bolt 50 and toothed bracket member 51. Mounting plate 20 is a flat, generally rectangular, elongated plate having two longitudinally-spaced mounting slots 21 and 22 defined therethrough and extending longitudinally along the length dimension of the plate. Slots 21 and 22 serve as mounting holes by which the mounting plate 20 can be secured to the chimney 10 by mounting screws, or the like. In the illustrated embodiment, the means for securing the mounting plate to the chimney includes a pair of radially-expandable screw retaining members 23 which are inserted into respective bores formed in respective mortar portions 13 of the chimney at the time of installation. Screw retaining members 23 receive respective screws 24 which are inserted through slots 21, 22 and tightened to receive mounting plate 20 with its flat rear surface flush against the chimney. The peripheral configuration of mounting plate 20 is not of crucial importance, although as a practical matter it is desirable that the plate be as small and lightweight as possible. However, at least one of the mounting holes 21, 22 must be an elongated slot which is longitudinally aligned with the other mounting hole which may be a small round hole large enough only to receive screw 24. The purpose of having at least one elongated slotted mounting hole is to assure that the mounting plate can be positioned on the chimney such that both mounting holes overlie a mortar section 13. One or more cradle mounting holes 25 are defined through mounting plate 20, preferably at a location intermediate two mounting slots 21, 22. Holes 25 are countersunk at the rear surface of mounting plate 20 to receive a nut 26 which engages a screw 27 used to secure the cradle 30 and spacer 40 to the mounting plate 20.

Cradle member 30 takes the form of a longitudinally-truncated pipe section having a concave mast support 31 and a convex rear surface 33. A mounting hole 35 is defined through the cradle member and is preferably countersunk at mast support surface 31 to receive the head of screw 27. Mast support surface 31, by virtue of its concavity, has an arcuate cross-section which subtends an arc that is less than 180°. In the preferred embodiment of the invention this arc is greater than 120°. The importance of these arcuate length limitations will become apparent from the description set forth below with respect to FIGS. 7 and 8. In addition, the axial length of the mast support surface 31 must be considerably greater than the arcuate length of its cross-section. This feature is required to provide firm contact support for mast 15 along an extended portion of the mast length. In this regard it is important that the axial length of surface 31 be at least twice, and preferably four to eight times, the arcuate length.

Figure 6:
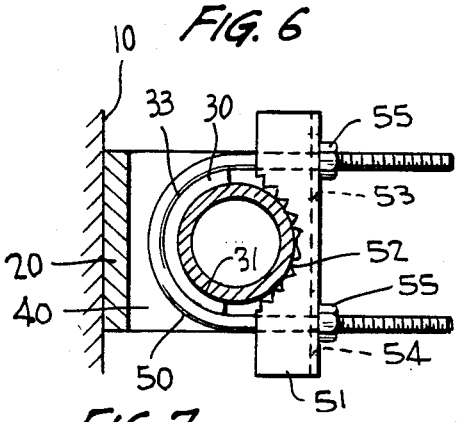
FIG. 6 is a view in section taken along lines 6—6 of FIG. 5.

The radius of curvature of mast support surface 31 is selected to match the radius of the outer wall of a typical antenna mast, as best illustrated in FIG. 6. This provides maximum surface contact between the support surface 31 and and antenna mast 15 along the arcuate length of the support surface. In a typical embodiment, this radius is 11/16 inch. The axial length of surface 31 is typically six inches.

Spacer element 40 has a flat rear surface 41 (as best seen in FIG. 5) and an arcuate front surface 43 (as best seen in FIG. 2). Flat rear surface 41 is placed flush against the forward surface of mounting plate 20. The concave front surface 43 is arcuately contoured to match and receive the convex rear surface 33 of cradle member 30. The axial and arcuate lengths of spacer front surface 43 can be less than the corresponding dimensions of the abutting rear surface 33 of cradle member 30. A mounting hole 45 is defined through spacer 40 from front to back to permit screw 27 to pass therethrough when the cradle 30, spacer 40 and mounting plate 20 are secured together.

The thickness of spacer 40 between its rear surface 41 and front surface 43 determines the transverse spacing of cradle 30 and mast 15 from chimney 10. In this respect, additional interchangeable spacer elements 40' and 40'' (see FIG. 2) of different thicknesses may be provided to properly space the mast 15 from the chimney for different projecting widths of overhang lip 17. Spacer elements 40, 40' and 40'' are identical in all respects except for the thickness dimension. Typically, the thickness of spacers 40, 40' and 40'' may be one inch, one and one-half inch, and one-half inch, respectively. Of course, other thickness dimensions may be employed.

The U-bolt 50 is generally placed with its arcuate base portion surrounding the rear surface 33 of cradle member 30 and its legs projecting forwardly of the cradle member. Bracket plate 51 has two parallel planar sections with arcuately-recessed portions in which pointed teeth 52 are defined. A connection section of the bracket plate perpendicularly joins the two parallel sections and is provided with two through holes 53 and 54. In securing the mast 15 to cradle member 30 along mast support surface 31, bracket 51 is slipped onto the U-bolt with the legs of the U-bolt extending through bracket hole 53, 54 and with teeth 52 facing mast 15. The legs of the U-bolt are threaded to receive nuts 55, which may be wing nuts, which are then tightened to force teeth 52 against the mast to hold the mast securely in the cradle.

Although a single mounting unit may be sufficient to securely mount the antenna mast 15 to chimney 10 in many cases due to the axially elongated support surface 31, it should be noted that two axially aligned units, as shown in FIG. 1, provide even greater security for all installations.

Figure 7:
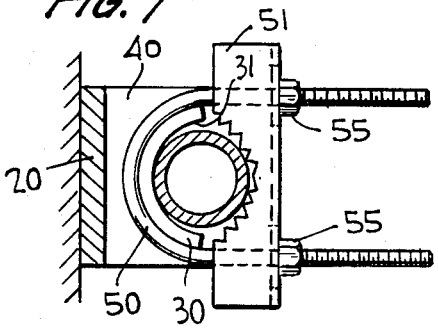
FIG. 7 is a view in section, similar to FIG. 6 but showing a supported mast with an undersize diameter relative to the support cradle cross-section.
Figure 8:
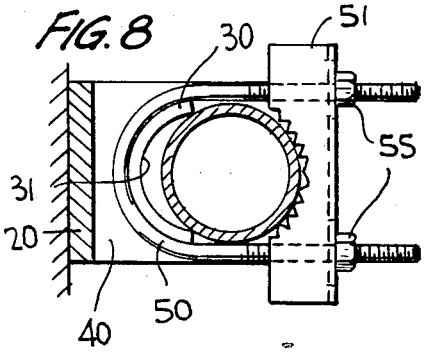
FIG. 8 is a view in section, similar to FIG. 6, but showing a supported mast with an oversize diameter relative to the support cradle cross-section.

Referring to FIGS. 7 and 8, it should be noted that the present invention permits a secure mounting of a mast even if the outside curvature of the mast does not conform precisely to the curvature of support surface 31. An undersize mast, as seen in FIG. 7, for example, is urged against the arcuate mast support surface 31 by bracket plate 51 which holds the mast securely in place within the cradle. Likewise, for an oversize mast such as illustrated in FIG. 8, the mast is contacted by both longitudinally extending edges of surface 31 and is held in place by bracket plate 51. Although the broad arcuate area contact with the mast is not present for oversize and undersize masts, the axially elongated cradle provides contact along relatively long segments of the mast to assure proper mounting support.

As illustrated in FIG. 4, and as briefly described above, by rotating spacer 40 relative to mounting bracket 20, it is possible to change the angular orientation of the mast relative to mounting plate 20. In FIG. 4 the cradle is shown oriented perpendicular to the length dimension of the mounting plate but it will be appreciated that any angular orientation can be obtained.

Figure 9:
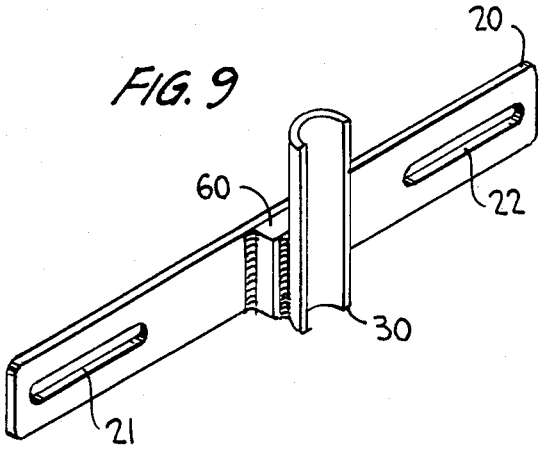
FIG. 9 is a view in perspective of another embodiment of the mast mounting unit of the present invention.

An alternative embodiment of the invention is illustrated in FIG. 9 wherein the cradle 30 and mounting plate 20 are joined by a spacer 60 and all three elements are fused together by welding, brazing, or the like. The resulting integral structure lacks the flexibility of positioning the cradle, both angularly and in its spacing from the mounting plate. However, for some applications this lack of flexibility may be acceptable and more convenient. Cradle 30 is shown in FIG. 9 to be fixed perpendicular to the length dimension of mounting plate 20 but it may be fixed in any angular orientation.

Having described several embodiments of a new and improved mast mounting arrangement constructed according to the present invention, it is believed that other modifications, variations and changes will be suggested to those skilled in the art in the light of the above teachings. It is therefore to be understood that all such variations, modifications and changes are believed to fall within the scope of the invention as defined by the appended claims.

What is claimed is:

1. A mounting assembly for securing a mast to a wall, said mounting assembly comprising:

a mounting plate having a flat rear surface;

a mast-receiving cradle member having an elongated mast support surface extending axially parallel to the lengthwise dimension of the mast and having an arcuate cross-section, wherein the axial length of said support surface is at least twice the arcuate length of said cross-section;

means for mounting said mounting plate on said wall with the entire flat rear surface disposed flush against the wall, said means for mounting including at least two lengthwise-spaced mounting holes defined through said mounting plate;

means securing said cradle and said mounting plate to one another in spaced relation such that, when said mounting plate is secured to said wall, the axial dimension of said support surface extends generally parallel to and is spaced transversely from said wall; and means for clamping the mast against said cradle member at said support surface.

2. The mounting assembly according to claim 1 wherein said arcuate length corresponds to an arc of a circle and is less than 180°.

3. The mounting assembly according to claim 2 wherein said securing means, said mounting plate and said cradle member are fused together to form an integral unit.

4. A mounting assembly for securing a mast to a wall, said mounting assembly comprising:

a mounting plate adapted to be secured to said wall;

a mast-receiving cradle member having an elongated mast support surface extending axially parallel to the lengthwise dimension of the mast and having an arcuate cross-section, wherein the axial length of said support surface is at least twice the arcuate length of said cross-section;

means securing said cradle and said mounting plate to one another in spaced relation such that, when said mounting plate is secured to said wall, the axial dimension of said support surface extends generally parallel to and is spaced transversely from said wall; and means for clamping the mast against said cradle member at said support surface;

and wherein said cradle member and said mountng plate are separable elements and wherein said securing means comprises a spacer element having a thickness selected to determine the spacing of said cradle member support surface from said wall.

5. The mounting assembly according to claim 4 wherein said mounting plate, said cradle member and spacer element are provided with respective assembly securing holes which can be aligned to receive a bolt-like assembly securing member.

6. The mounting assembly according to claim 5 wherein said cradle member is a longitudinally-truncated tube member, and wherein said spacer element comprises a flat surface adapted to abut said mounting plate and a generally cylindrical recessed surface adapted to receive said truncated tube member.

7. A mounting assembly for securing a mast to a wall, said mounting assembly comprising:

a mounting plate adapted to be secured to said wall;

a mast-receiving cradle member having an elongated mast support surface extending axially parallel to the lengthwise dimension of the mast and having an arcuate cross-section, wherein the axial length of said support surface is at least twice the arcuate length of said cross-section;

means securing said cradle and said mounting plate to one another in spaced relation such that, when said mounting plate is secured to said wall, the axial dimension of said support surface extends generally parallel to and is spaced transversely from said wall; and means for clamping the mast against said cradle member at said support surface;

wherein said arcuate length corresponds to an arc of a circle and is less than 180°;

and wherein said mounting plate comprises a flat plate having at least two mounting holes for screws defined therethrough, at least one of said mounting holes being configured as an elongated slot.

8. The mounting assembly according to claim 2 wherein said clamping means comprises:

a U-bolt disposed partially about said cradle and having parallel legs extending transversely away from said mounting plate and beyond said support surface;

a locking plate having plural tooth-like projections; and means securing said locking plate to the legs of said U-bolt with said tooth-like projections tightly engaging the mast and urging the mast against said cradle member.

9. A mounting assembly for securing a mast in spaced relation to a support wall, said assembly comprising:

first and second mounting plates secured to said wall;

first and second cradle members secured to said first and second mounting plates, respectively, each cradle member including an elongated mast support surface extending axially in the lengthwise dimension of the supported mast and having an arcuate cross-section, the mast support surface of the first and second cradle members being positioned in axial alignment, wherein the axial length of each mast support surface is at least twice its arcuate length, and wherein the arcuate length of each mast support surface is less than 180°; and means for clamping the mast against said mast support surfaces;

wherein each mounting plate and each cradle member are separate units secured together by a respective spacer element having a thickness selected to determine the spacing between the mast and said support wall.

10. The mounting assembly according to claim 9 wherein each mounting plate and its respective cradle member and spacer element are provided with respective assembly securing holes which can be aligned to receive a bolt-like assembly securing member.

11. The mounting assembly according to claim 10 wherein each cradle member is a longitudinally-truncated tube member, and wherein each spacer element comprises a flat surface adapted to abutt its respective mounting plate and a generally cylindrical recessed surface adapted to receive its respective truncated tube member.

12. A mounting assembly for securing a mast in spaced relation to a support wall, said assembly comprising:

first and second mounting plates secured to said wall;

first and second cradle members secured to said first and second mounting plates, respectively, each cradle member including an elongated mast support surface extending axially in the lengthwise dimension of the supported mast and having an arcuate cross-section, the mast support surface of the first and second cradle members being positioned in axial alignment, wherein the axial length of each mast support surface is at least twice its arcuate length, and wherein the arcuate length of each mast support surface is less than 180°; and means for clamping the mast against said mast support surfaces;

wherein each mounting plate comprises a flat plate having at least two mounting holes for screws defined therethrough, at least on of said mounting holes being configured as an elongated slot.

13. A mounting assembly for securing a mast in spaced relation to a masonry support wall of bricks spaced by mortar, said assembly comprising:

at least one mounting plate having a front surface and a flat rear surface adapted to abut said support wall, said mounting plate having at least two mounting holes defined therethrough, at least one of said mounting holes being sufficiently elongated in one dimension to permit alignment of both mounting holes with mortar portions of said support wall;

at least one cradle member for receiving and supporting the mast, said cradle member having an elongated mast support surface with an arcuate cross-section, the elongated dimension of the mast support surface extending parallel to the lengthwise dimension of the supported mast;

means securing said cradle member to the front surface of said mounting plate with said mast support surface facing generally away from said mounting plate; and means for selectively clamping the mast against said cradle member along said mast support surface.

14. The mounting assembly according to claim 13 wherein said mast support surface has an axial length which is at least twice it arcuate cross-section length, and wherein the arcuate cross-section is an arc of a circle and less than 180°.

15. The mounting assembly according to claim 13 further comprising:

a second mounting plate, substantially identical to said at least one mounting plate;

a second cradle member, substantially identical to said at least one cradle member;

means securing said second cradle member to the front surface of said second mounting plate with said mast support surface of said second cradle member facing generally away from said second mounting plate;

means for selectively clamping the mast against said second cradle member along said mast support surface of the second cradle member; and means securing said one and said second mounting plate to said support wall with said mast support surfaces in axial alignment.

16. The mounting assembly according to claim 13 wherein said cradle member and said mounting plate are separable elements and wherein said securing means comprises a spacer element having a thickness selected to determine the spacing of said cradle member support surface from said wall.

17. The mounting assembly according to claim 16 wherein said cradle member is a longitudinally-truncated tube member, and wherein said spacer element comprises a flat surface adapted to abut said mounting plate and a generally cylindrically recessed surface adapted to receive said truncated tube member.

* * * * *